US009587900B2

(12) United States Patent
Kereth

(10) Patent No.: US 9,587,900 B2
(45) Date of Patent: Mar. 7, 2017

(54) OMNI-DIRECTIONAL RECOIL ENERGY ABSORPTION MECHANISM

(71) Applicant: Yefim Kereth, Rehovot (IL)

(72) Inventor: Yefim Kereth, Rehovot (IL)

( * ) Notice: Subject to any disclaimer, the term of this patent is extended or adjusted under 35 U.S.C. 154(b) by 248 days.

(21) Appl. No.: 14/641,721

(22) Filed: Mar. 9, 2015

(65) Prior Publication Data

US 2016/0258703 A1 Sep. 8, 2016

(30) Foreign Application Priority Data

Mar. 16, 2014 (IL) ..... 231545

(51) Int. Cl.
*F41A 25/12* (2006.01)

(52) U.S. Cl.
CPC ..... *F41A 25/12* (2013.01)

(58) Field of Classification Search
CPC ..... F41A 25/12; F41A 25/10; F41A 25/00; F41A 25/18
USPC ..... 89/37.14, 42.01, 44.01, 44.02
See application file for complete search history.

(56) References Cited

U.S. PATENT DOCUMENTS 2,269,297 A * 1/1942 White ..... F41A 25/18 89/37.14
2,475,090 A * 7/1949 Green ..... F41A 19/08 89/37.03
2,491,005 A * 12/1949 Green ..... F41A 19/08 384/242
3,757,636 A * 9/1973 Chiabrandy ..... F41A 3/82 89/169
3,969,982 A * 7/1976 Pier-Amory ..... F41A 25/12 89/178
4,467,697 A * 8/1984 Witt ..... F41A 5/22 89/191.01
4,574,685 A * 3/1986 Sanborn ..... F41A 23/34 89/36.13
5,655,632 A * 8/1997 Valembois ..... F16F 1/32 188/136
6,286,411 B1 * 9/2001 Sanderson ..... F41A 23/20 89/37.03
8,297,174 B1 * 10/2012 Russell ..... F41A 25/12 89/37.14
2016/0102945 A1 * 4/2016 Itzkowitz ..... F41G 5/16 89/37.14

* cited by examiner

*Primary Examiner* — Michael David
(74) *Attorney, Agent, or Firm* — Stetina Brunda Garred & Brucker

(57) ABSTRACT

An omni-directional recoil energy absorption mechanism has a slipping disk supported by a support plate carrying a weapon; and a cover plate covering the slipping disk and capturing it to create a sandwich structure of cover plate, slipping disk and support plate. Bolts act in conjunction with pressure springs to press the cover plate to the slipping disk toward the support plate and create friction forces in a plane of the slipping disk. Tension springs connect the slipping disk to the support plate under recoil force configured to return the slipping disk and the weapon to an initial position, in a center of the support and cover plates. The springs are preloaded to a pre-defined level to oppose, flexibly, the recoil forces in any vertical and radial directions, while absorbing the recoil energy by allowing the slipping of the slipping disk in between the cover and support plates.

4 Claims, 3 Drawing Sheets

OMNI-DIRECTIONAL RECOIL ENERGY ABSORPTION MECHANISM

CROSS-REFERENCE TO RELATED APPLICATIONS

The present application claims priority to Israeli Application No 231545 filed on Mar. 16, 2014.

STATEMENT RE: FEDERALLY SPONSORED RESEARCH/DEVELOPMENT

Not Applicable

BACKGROUND

Field of the Invention

This invention relates to an omni-directional recoil energy absorption mechanism.

A recoil energy absorption mechanism is an important part of the weapon station, as it reduces the impacts loads and improves the durability of the system.

A typical recoil energy absorption mechanism is closely coupled to the machine gun and acts in a direction of the machine gun barrel. This close coupling requires the accuracy of the typical mechanism to be high, and therefore drives its production costs up.

BRIEF SUMMARY

It is therefore an object of the present invention to provide a low cost recoil energy absorption mechanism.

This object is realized in accordance with a broad aspect of the invention by an omni-directional recoil energy absorption mechanism, comprising:

- a slipping disk at least indirectly carrying a weapon;
- a support plate at least indirectly attached to the ground or to a vehicle platform and supporting the slipping disk;
- a cover plate covering the slipping disk and capturing it in between so as to create a sandwich-like structure of cover plate, slipping disk and support plate;
- bolts acting in conjunction with pressure spring elements so as to press the cover plate to the slipping disk toward the support plate and create friction forces in a plane of the slipping disk; and
- tension spring elements connecting the slipping disk to the support plate and under recoil force configured to return the slipping disk and the weapon to an initial position, in a center of the support and the cover plates;
- said pressure and tension spring elements being preloaded to a pre-defined level to oppose, flexibly, the recoil forces in any direction, while absorbing the recoil energy by allowing the slipping of the slipping disk in between the cover and support plates.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

Figure 1:
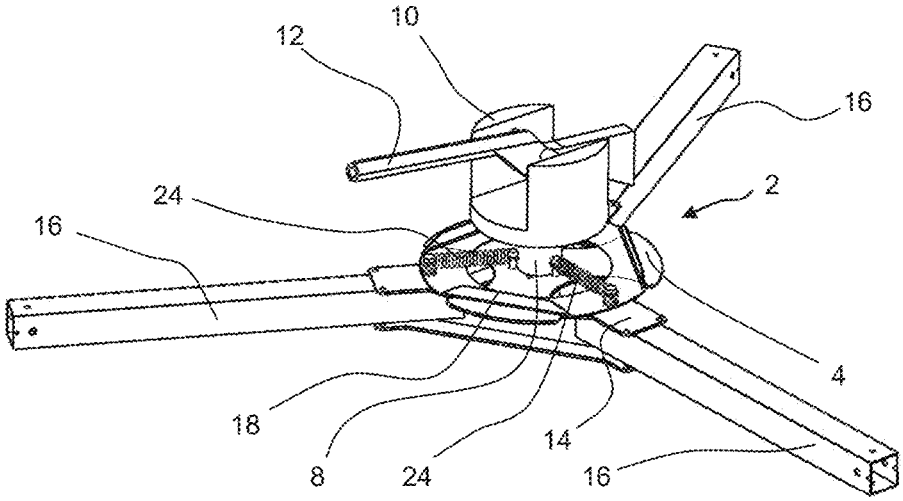
FIG. 1 is a general representation of an omni-directional recoil energy absorption mechanism over a tripod in perspective view.
Figure 2:
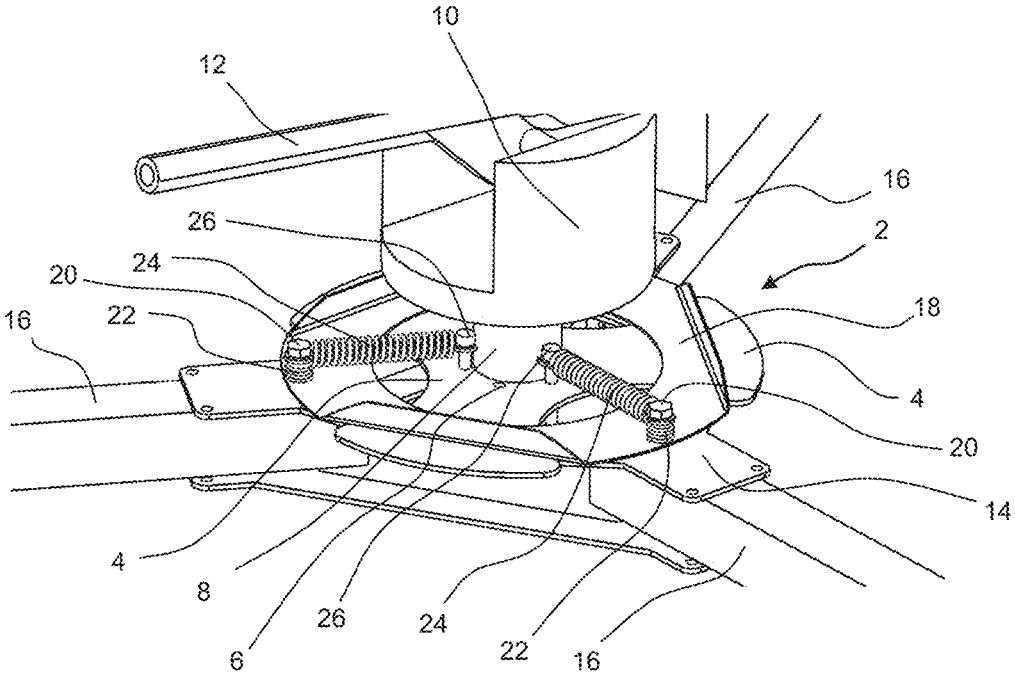
FIG. 2 is a general representation showing in close-up a detail of the omni-directional recoil energy absorption mechanism.
Figure 3:
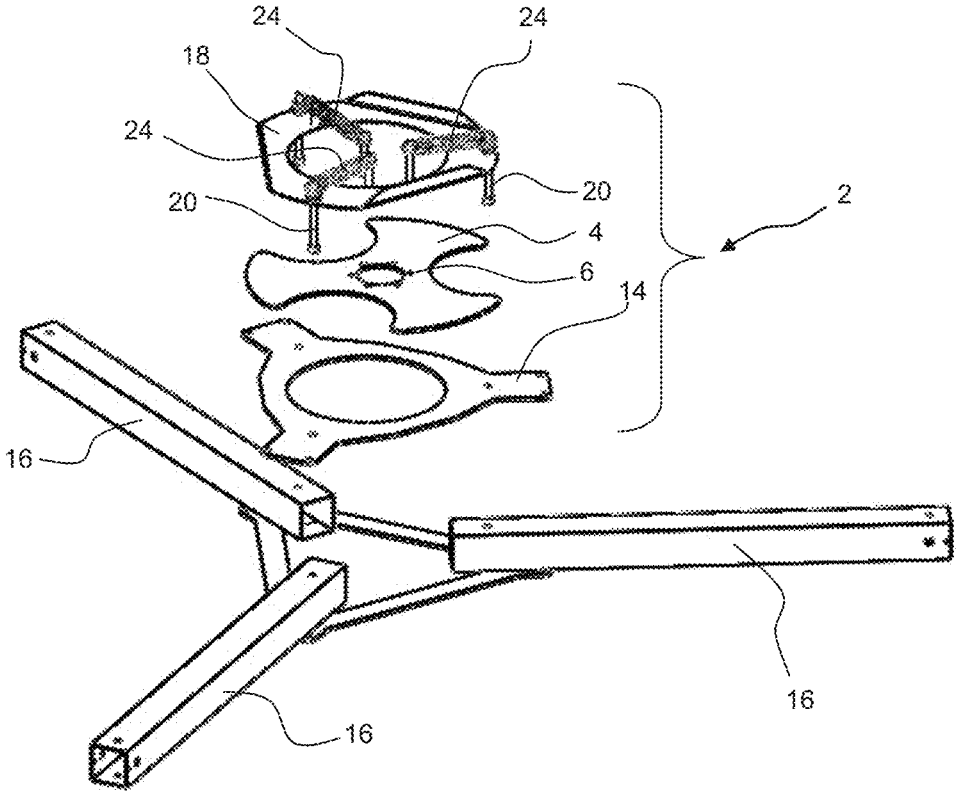
FIG. 3 is a general representation of the omni-directional recoil energy absorption mechanism in an exploded view.

FIGS. 1, 2 and 3 are general representations of an omni-directional recoil energy absorption mechanism shown generally as 2 comprising a fan-shaped slipping disk 4 and having at its hub three or more holes 6. The slipping disk 4 is connected via its hub to a weapon station neck 8. The weapon station neck 8 carries a weapon station 10, which is capable of changing the azimuth and the elevation angles of the machine gun 12. The slipping disk 4 leans on a support plate 14 which is coupled to tripod legs 16 that convey the weight of the weapon station 10 and the recoil forces to the ground (e.g. soil—not shown), or to structures (e.g. building—not shown), or to platforms (e.g. armored vehicle—not shown). The slipping disk 4 is covered by a cover plate 18 in such a way that the weapon station neck 8 is surrounded by an opening in the center of the cover plate 18.

Figure 4:
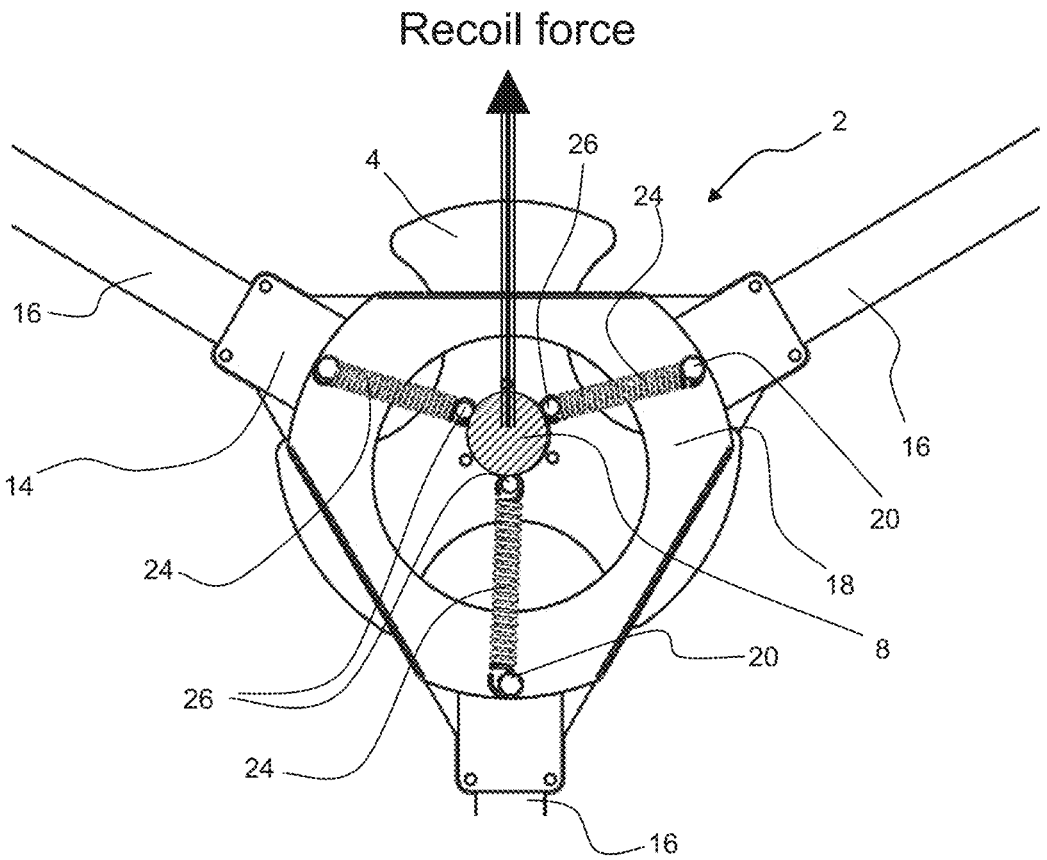
FIG. 4 is a top-down cross-sectional view of the omni-directional recoil energy absorption mechanism at weapon station neck, under the recoil forces.

The sandwich-like structure of three elements: cover plate 18, slipping disk 4 and support plate 14 (see an exploded view in the FIG. 3) is connected together by the bolts 20 that press these elements together via the pressure springs 22 (FIG. 2) and thus create friction forces in a plane of the slipping disk 4. Initially, the slipping disk 4 is concentric to the support and cover plates 14 and 18. This concentric position is achieved as a result of three (or more) radial tension springs 24 that connect the bolts 20, which are stationary relatively to the tripod legs 16, to the bolts 26 of the slipping disk 4 hub, which are floatable relative to the tripod legs 16. If there is no recoil force, the tension springs 24 will keep the slipping disk 4 at its initial position, at the center of the plates 14 and 18. As may be seen in FIG. 4, under the recoil force, the slipping disk 4 will slip in between the support and cover plates 14 and 18, while some of the tension springs 24 undergo an elongation such that their tension increases (the spring at a bottom of FIG. 4) and others undergo a release such that their tension decreases (the two springs at the top of FIG. 4). The elongation and release of the springs may be reciprocal, until equilibrium is reached. Slippage of the slipping disk 4 will result in conversion of the mechanical energy into heat, and in a dramatic reduction of the impact forces. At the end of the response of the mechanism 2 to the recoil force, the radial arrangement of tension springs 24 will bring the slipping disk 4 back to its initial position and the mechanism 2 will be ready again for a new cycle.

The direction of slippage of the slipping disk 4 will align itself to the recoil force vector of the machine gun whatever its azimuth and the elevation angles are.

The pressure springs 22 and tension springs 24 are preloaded to the pre-defined level to allow an optimal distance of slippage.

To achieve higher efficiency, the friction forces between the slipping disk 4 and the support and cover plates 14 and 18 can be increased by using friction material, similar to the materials of the brake pads commonly used in the automobile industry. This friction material can be bound on the upper and/or bottom surfaces of the slipping disk 4, or alternatively, it can be bound to the upper surface of the support plate 14 and/or bottom surface of the cover plate 18.

The production of the mechanism 2 requires low to moderate accuracy and therefore can be inexpensive. The mechanism 2 allows energy absorption regardless of the direction of the weapon station 10 and it does not affect the aiming accuracy of the weapon.

It will be appreciated that although the omni-directional recoil energy absorption mechanism has been described with specific reference to ground or vehicle installation, this is by way of non-limiting example only and the omni-directional recoil energy absorption mechanism according to the invention may be installed over other structures as well. Likewise, while in the embodiments described above the omni-directional recoil energy absorption mechanism has three vertical and three radial spring elements, in other applications, the omni-directional recoil energy absorption mechanism may have a larger number of spring elements.

What is claimed is:

1. An omni-directional recoil energy absorption mechanism, comprising:

a slipping disk at least indirectly carrying a weapon;

a support plate at least indirectly attached to the ground or to a vehicle platform and supporting the slipping disk;

a cover plate covering and capturing the slipping disk creating a sandwiched structure of cover plate, slipping disk and support plate;

bolts acting in conjunction with pressure spring elements so as to press the cover plate to the slipping disk toward the support plate and create friction forces in a plane of the slipping disk; and tension spring elements connecting the slipping disk to the support plate and under recoil force configured to return the slipping disk and the weapon to an initial position, in a center of the support and the cover plates;

said pressure and tension spring elements being preloaded to a pre-defined level to oppose, flexibly, the recoil forces in any direction, while absorbing the recoil energy by allowing the slipping of the slipping disk in between the cover and support plates.

2. The omni-directional recoil energy absorption mechanism according to claim 1, wherein the spring elements are springs.

3. The omni-directional recoil energy absorption mechanism according to claim 1, wherein a surface of the slipping disk is covered by material of high friction coefficient.

4. The omni-directional recoil energy absorption mechanism according to claim 2, wherein a surface of the slipping disk is covered by material of high friction coefficient.

* * * * *